US008108956B2

(12) United States Patent
Forrest

(10) Patent No.: US 8,108,956 B2
(45) Date of Patent: Feb. 7, 2012

(54) FASTENER CONCEALMENT CAP FOR GRAB BAR ASSEMBLY

(75) Inventor: Earl David Forrest, Asheboro, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 1018 days.

(21) Appl. No.: 12/036,324

(22) Filed: Feb. 25, 2008

(65) Prior Publication Data

US 2009/0211015 A1 Aug. 27, 2009

(51) Int. Cl.
*A47K 3/024* (2006.01)

(52) U.S. Cl. ..... 4/576.1; 4/417

(58) Field of Classification Search ..... 16/402, 16/412, 444, DIG. 24, 404, 441; 297/183.9, 297/183.7, 183.1; 4/576.1, 417, 240; 411/372.5, 411/372.6, 373, 377, 413; 220/288
See application file for complete search history.

(56) References Cited

U.S. PATENT DOCUMENTS

| | | | | |
|---|---|---|---|---|
| 4,087,141 | A * | 5/1978 | Roberts | 312/348.6 |
| 6,106,055 | A * | 8/2000 | Fischer | 296/214 |
| 6,553,629 | B2 * | 4/2003 | Grady et al. | 16/444 |
| 6,609,274 | B2 * | 8/2003 | Christensen et al. | 16/412 |
| 6,668,424 | B1 * | 12/2003 | Allen et al. | 16/444 |
| 7,270,359 | B2 * | 9/2007 | Sparks et al. | 296/1.02 |

FOREIGN PATENT DOCUMENTS

JP 2000336878 12/2000

OTHER PUBLICATIONS

Office Action dated Jan. 28, 2011, Canadian Patent Application No. 2,622,438.

* cited by examiner

*Primary Examiner* — Gregory Huson
*Assistant Examiner* — Lauren Heitzer
(74) *Attorney, Agent, or Firm* — Carlson Gaskey & Olds P.C.

(57) ABSTRACT

A grab bar assembly includes tabs which engage respective pockets to position a cap within a grab bar recessed area. The tabs and pockets position the cap while a locking tab secures the cap within the recessed area.

13 Claims, 3 Drawing Sheets

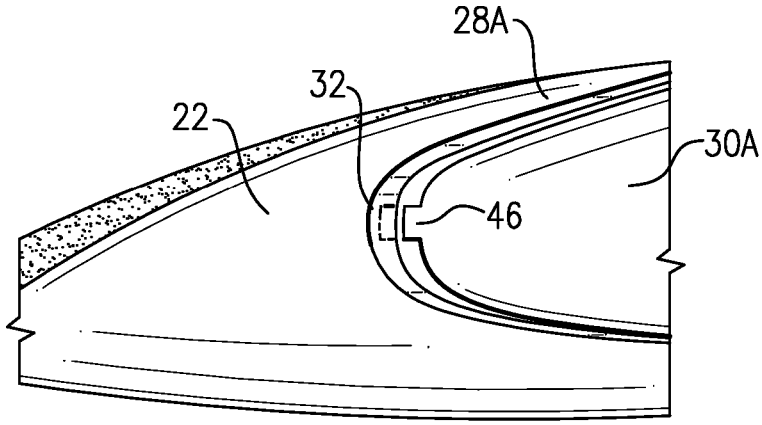
FIG.3A
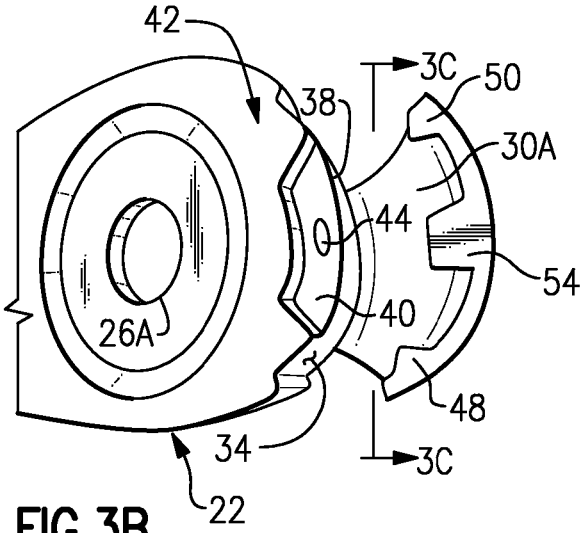
FIG.3B
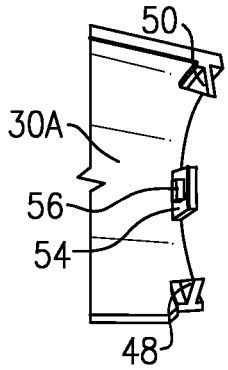
FIG.3C
FIG.3D
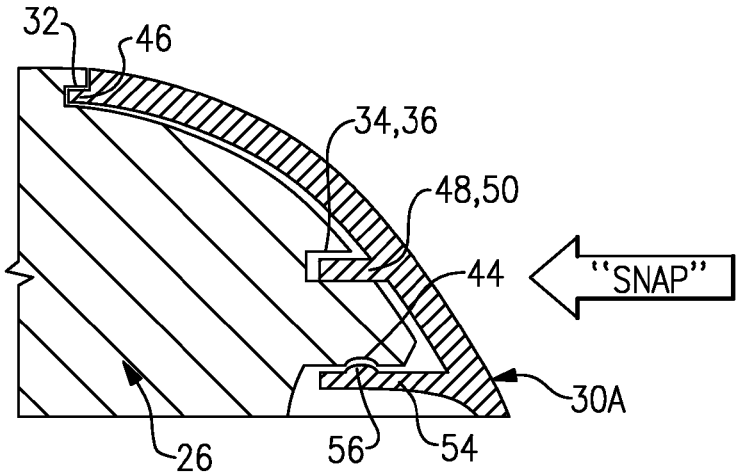

FASTENER CONCEALMENT CAP FOR GRAB BAR ASSEMBLY

BACKGROUND

The present invention relates to a grab bar for use in a bath or shower, and more particularly to a concealment cap which cover fasteners which mount the grab bar.

Luxury showers and tubs are becoming increasing popular. Many hotels install some sort of grab bar to provide a hand hold when for entrance and exit of the shower or tub. Conventional grab bars are typically fastened to the wall with threaded installation fasteners. Each grab bar installation fastener is often covered by a cap for aesthetic and corrosion reasons. With highly contoured grab bars, the caps are often difficult to install without fasteners of their own.

SUMMARY

A grab bar assembly according to an exemplary aspect of the present invention includes: a grab bar comprising a recessed area, the recessed area comprising an aperture within the recessed area, a first pocket, a second pocket and a third pocket, the second pocket and the third pocket adjacent a step surface having a detent; and a cap receivable within the recessed are, the cap comprising a first tab, a second tab, and a third tab which correspond respectively with the first pocket, the second pocket and the third pocket, the cap comprising a locking tab located generally adjacent the second tab and the third tab, the locking tab comprises a protrusion receivable within the detent.

A grab bar assembly according to another exemplary aspect of the present invention includes: a grab bar comprising a recessed area, the recessed area comprising an aperture within the recessed area, a first pocket, a second pocket and a third pocket, the second pocket and the third pocket adjacent a step surface having a first rib; and a cap receivable within the recessed are, the cap comprising a first tab, a second tab, and a third tab which correspond respectively with the first pocket, the second pocket and the third pocket, the cap comprising a keyhole slot protrusion located generally adjacent the second tab and the third tab, the keyhole slot protrusion engageable with the first rib.

BRIEF DESCRIPTION OF THE DRAWINGS

The various features and advantages of this invention will become apparent to those skilled in the art from the following detailed description of the disclosed non-limiting embodiment. The drawings that accompany the detailed description can be briefly described as follows:

FIG. 3A is an expanded top view of a contoured cap which is "snap" fit onto the grab bar to complete the shape thereof, FIG. 3B is an expanded bottom view of a contoured cap which is "snap" fit onto the grab bar to complete the shape thereof, FIG. 3C is an expanded inner view of the contoured cap;

FIG. 3D is a side sectional view of the contoured cap fitted to the grab bar to complete the shape thereof.

DETAILED DESCRIPTION OF THE EXEMPLARY EMBODIMENTS

Figure 1:
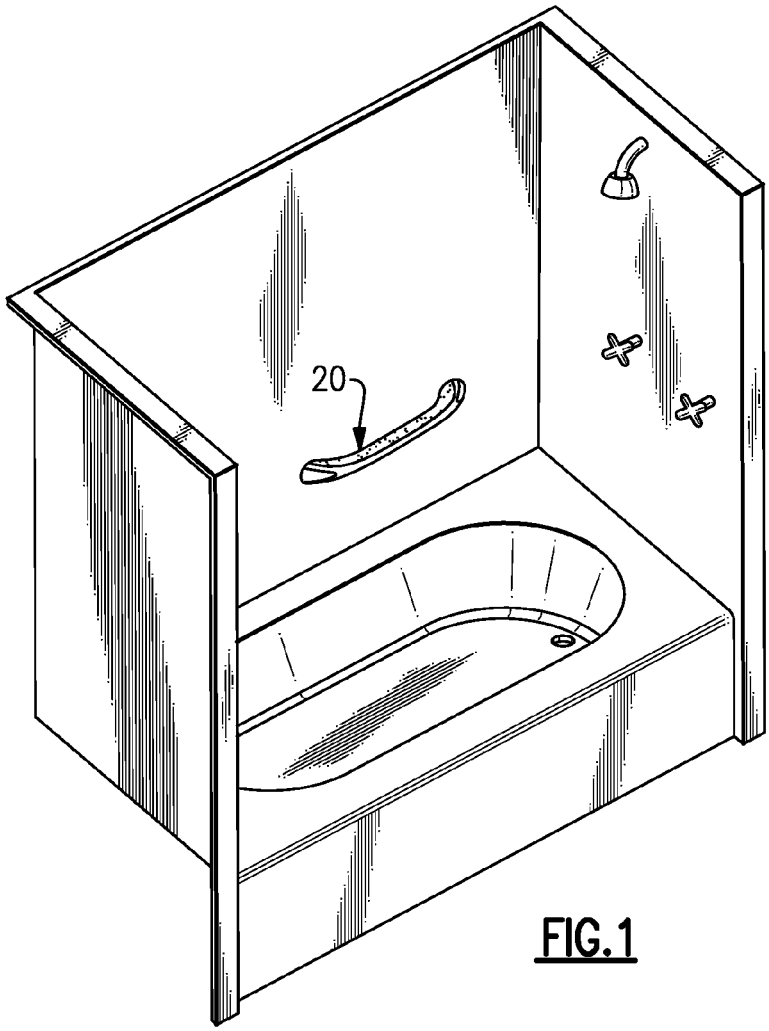
FIG. 1 is a general view a tub and shower surround having a grab bar assembly according to the present invention.

FIG. 1 schematically illustrates an exemplary tub or shower 10 with a grab bar assembly 20 of the present invention. The grab bar assembly 20 in one non-limiting embodiment is of an organic or highly contoured non-linear design manufactured of molded plastic or other moldable material.

Figure 2:
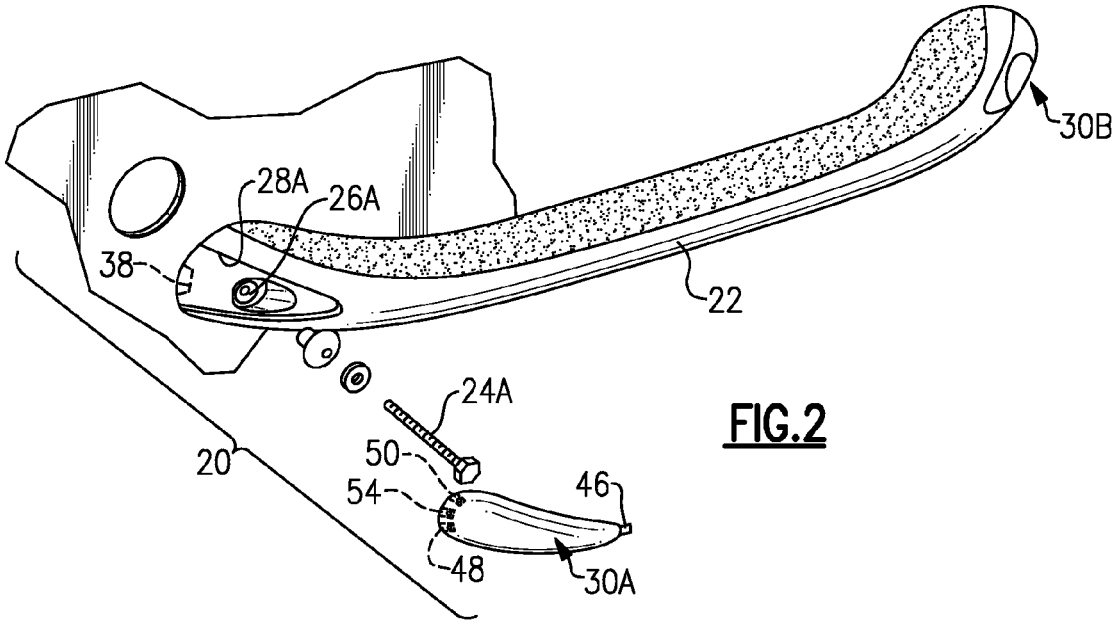
FIG. 2 is a top view of the grab bar assembly.

Referring to FIG. 2, the grab bar assembly 20 generally includes a grab bar 22 which receives a first mount fastener 24A through a first aperture 26A and a second mount fastener 24B through a second aperture 26B. While the second mount fastener 24B and second aperture 26B are not shown in the drawings, it is to be understood that these features substantially correspond to the first mount fastener 24A and first aperture 26A, and are associated with the end of the grab bar assembly 20 near the cap 30B. The apertures 26A, 26B are located within a recessed area 28A, 28B which are covered by a respective contoured cap 30A, 30B which are "snap" fit onto.the grab bar 22 to complete the shape thereof. As each cap 30A, 30B is essentially equivalent, only one need be describe in detail herein.

Referring to FIG. 3A, the grab bar 22 includes a first pocket 32 on one side of the aperture 26A along an edge of the recessed area 28A. A second pocket 34 and a third pocket 36 are located on an opposite side of the aperture 26A adjacent an edge 38 of the grab bar 22 (FIG. 3B). The first pocket 32, the second pocket 34 and the third pocket 36 define a generally triangular relationship. The second pocket 34 and the third pocket 36 are located adjacent a step surface 40 in an underside 42 of the grab bar 22. A detent 44 is located within the step surface 40 (FIG. 3B).

The cap 30A includes a first tab 46, a second tab 48 and a third tab 50 which correspond with the first pocket 32, the second pocket 34 and the third pocket 36. A locking tab 54 is located generally intermediate the second tab 48 and the third tab 50. The locking tab 54 includes a protrusion 56 (FIG. 3C) which is receivable within the detent 44.

Referring to FIG. 3D, the cap 30A is assembled into the recessed area 28A to cover the aperture 26A, the first tab 46, the second tab 48 and the third tab 50 are slid into the respective first pocket 32, second pocket 34 and third pocket 36. As the tabs 46, 48, 50 are slid into the respective pockets 32, 34, 36, the locking tab 54 operates a flexible beam such that the locking tab 54 flexes to lock the protrusion 56 into the detent 44 and provide a snap fit. The interface through the tabs 46, 48, 50 engagement with the respective pockets 32, 34, 36 requires the locking tab 54 to flex until the protrusion 56 engages with the detent 44. That is, the tabs 46, 48, 50 and respective pockets 32, 34, 36 position the cap 30A and operate to react the flex of the locking tab 54 such that the interaction of the protrusion 56 with the detent 44 locks the cap 30A within the recessed area 28A.

Figure 4A:
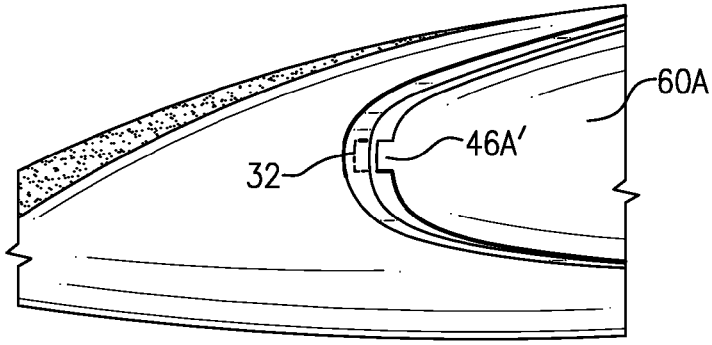
FIG. 4A is an expanded top view of another contoured cap which is "snap" fit onto the grab bar to complete the shape thereof.
Figure 4B:
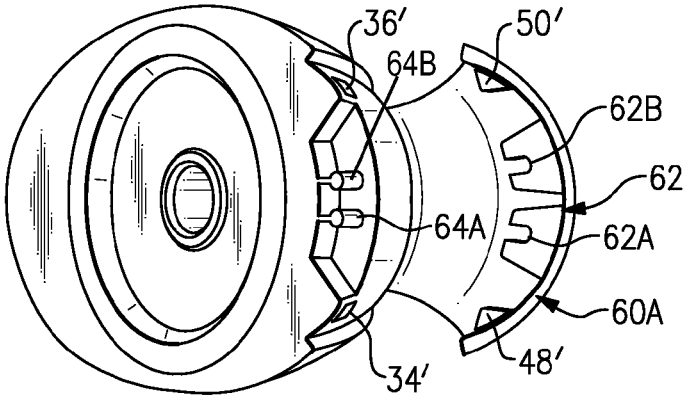
FIG. 4B is an expanded bottom view of another contoured cap which is "snap" fit onto the grab bar to complete the shape thereof.

Referring to FIGS. 4A and 4B, another cap 60A includes tabs 46', 48', 50' which engage with the respective pockets 32', 34', 36' generally as described with regard to the FIG. 3 embodiment. The cap 60A includes a locking tab 62 having a first keyhole slot 62A and a second keyhole slot 62B. The keyhole slots 62A, 62B respectively engage a first rib 64A and a second rib 64B to generate opposing forces or a "snap" fit which locks the cap 60A within the recessed area 28A'.

Figure 5:
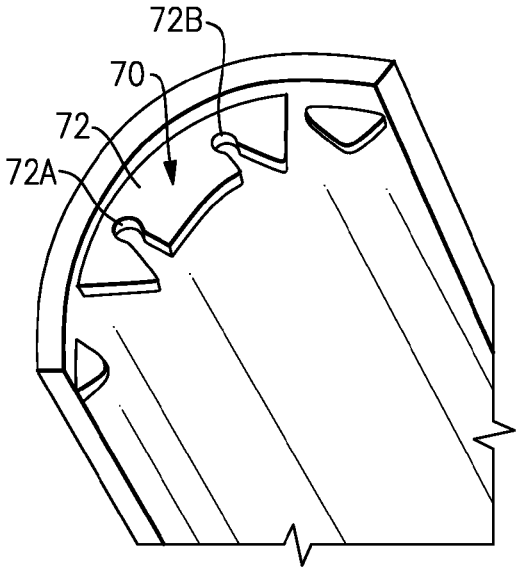
FIG. 5 is an expanded inner view of another contoured cap.

Referring to FIG. 5, another locking tab 70 includes a single protrusion 72 having both a first and a second keyhole slot 72A, 72B which may alternatively or additionally be utilized. It should be understood that separate positions (FIG. 4B) may be more preferred for more rigid materials while the embodiment of FIG. 5 may be more preferred for relatively more flexible materials.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The disclosed embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A grab bar assembly comprising:

a grab bar comprising a recessed area, said recessed area comprising an aperture within said recessed area, a first pocket, a second pocket and a third pocket, said second pocket and said third pocket adjacent a step surface having a detent; and a cap receivable within said recessed area, said cap comprising a first tab, a second tab, and a third tab which correspond respectively with said first pocket, said second pocket and said third pocket, said cap comprising a locking tab located generally adjacent said second tab and said third tab, said locking tab comprises a protrusion receivable within said detent.

2. The assembly as recited in claim 1, wherein said aperture extends through said grab bar.

3. The assembly as recited in claim 1, wherein said first pocket, said second pocket and said third pocket form a generally triangular relationship.

4. The assembly as recited in claim 1, wherein said step surface is located on an underside of said grab bar.

5. The assembly as recited in claim 1, wherein said grab bar is a non-linear shape.

6. The assembly as recited in claim 1, wherein said cap completes a shape of said grab bar and fills said recessed area.

7. A grab bar assembly comprising:

a grab bar comprising a recessed area, said recessed area comprising an aperture within said recessed area, a first pocket, a second pocket and a third pocket, said second pocket and said third pocket adjacent a step surface having a first rib; and a cap receivable within said recessed area, said cap comprising a first tab, a second tab, and a third tab which correspond respectively with said first pocket, said second pocket and said third pocket, said cap comprising a keyhole slot protrusion located generally adjacent said second tab and said third tab, said keyhole slot protrusion engageable with said first rib.

8. The assembly as recited in claim 7, wherein said keyhole slot protrusion comprises a first keyhole slot and a second keyhole slot.

9. The assembly as recited in claim 8, wherein said first keyhole slot and said second keyhole slot are formed within a single protrusion.

10. The assembly as recited in claim 1, wherein engagement of said grab bar with said locking tab causes the locking tab to flex relative to the remainder of the cap.

11. The assembly as recited in claim 1, wherein said detent is defined in said step surface.

12. The assembly as recited in claim 1, wherein said detent is located between said first and second pockets.

13. The assembly as recited in claim 8, wherein said step surface includes a second rib, said first keyhole slot engageable with said first rib and said second keyhole slot engageable with said second rib.

* * * * *